US006658812B1

(12) United States Patent
Tomlinson et al.

(10) Patent No.: US 6,658,812 B1
(45) Date of Patent: Dec. 9, 2003

(54) DOMED CONSTRUCTION

(76) Inventors: Andrew David Tomlinson, 41 Broadway, Llanblethian, Cowbridge (GB), CF71 7EX; Martin James Tomlinson, Bryn Hyfryd, Primrose Hill, Cowbridge (GB), CD71 7DU ( * ) Notice: Subject to any disclaimer, the term of this patent is extended or adjusted under 35 U.S.C. 154(b) by 0 days.

(21) Appl. No.: 10/048,240

(22) PCT Filed: Jul. 31, 2000

(86) PCT No.: PCT/GB00/02947

§ 371 (c)(1),
(2), (4) Date: Jan. 24, 2002

(87) PCT Pub. No.: WO01/09448

PCT Pub. Date: Feb. 8, 2001

(30) Foreign Application Priority Data

Jul. 29, 1999 (GB) ..... 9917711
Aug. 18, 1999 (GB) ..... 9919408

(51) Int. Cl.[7] ..... E04B 1/00; E04G 21/00; E04G 23/00

(52) U.S. Cl. ..... 52/745.07; 52/82; 52/745.06; 52/745.08; 52/745.13

(58) Field of Search ..... 52/745.06, 745.13, 52/82, 745.07, 745.08

(56) References Cited

U.S. PATENT DOCUMENTS

| | | | | |
|---|---|---|---|---|
| 4,625,472 A | | 12/1986 | Busick | |
| 4,680,901 A | | 7/1987 | Armitage | |
| 4,788,803 A | | 12/1988 | Seitz | |
| 4,873,796 A | | 10/1989 | Akmese | |
| 5,724,775 A | * | 3/1998 | Zobel, Jr. et al. | 52/82 |

FOREIGN PATENT DOCUMENTS

| | | |
|---|---|---|
| GB | 2051918 A | 1/1981 |
| WO | WO 97/28485 A1 | 8/1997 |

OTHER PUBLICATIONS

Quayle, J. P. et al., Kempe's Engineers Year–Book, Morgan–Grampian Book Publishing Co. Ltd. (90th Edition, 1985), pp. 13/4–13/15.

* cited by examiner

*Primary Examiner*—Carl D. Friedman
*Assistant Examiner*—Nahid Amiri
(74) *Attorney, Agent, or Firm*—Edwin D. Schindler

(57) ABSTRACT

A domed construction is formed by positioning and temporarily supporting a series of elongate structural elements in radially-extending positions, and forming structural joints between the adjoining radial edges of the structural elements, such that the series of structural elements form a self-supporting shell.

15 Claims, 4 Drawing Sheets

DOMED CONSTRUCTION

The present invention relates to a construction in the form of a concrete dome and to a method of forming such a construction.

Concrete shells are efficient and effective in carrying applied loads: the thin shell structures found in nature, particularly in molluscs, are noted for their strength. Concrete shells tend to require a lower quantity of material than alternative structures but are, however, difficult to construct. A conventional method, for forming a thin concrete shell structure, comprises the spraying of concrete onto formers: however, this method is time consuming and expensive. Shell structures can be formed using the traditional technique of pouring concrete into forms, but this involves considerable difficulties: in particular, the continually-changing surface profile of the shell structure makes the formwork complicated and expensive.

The use of pouring methods (as opposed to spraying), to form thin shells, involves the requirement to compact the concrete mix, and this presents difficulties. The most common method for compacting concrete uses an immersion poker: even with thick shell structures with double forms, there is a tendency for the immersion poker to get caught up in the reinforcing mesh; thin shell structures are even more troublesome. External vibrators can be used but, for best performance, they require steel forms, which are expensive, particularly for curved shapes.

Recent proposals for shell constructions, to avoid the difficulties and costs outlined above, comprise constructing the shell from a plurality of flat or near-flat panels which interfit together to form a domed formation which is nearly as efficient as if it had a continuous profile. This method of construction requires a temporary support structure to be erected, to support the pre-cast panels: structural joints are then made between all of the adjoining panels, after which the temporary support structure is removed. The method has the disadvantage that a large number of joints must be made, extending both radially and circumferentially of the dome construction: the jointing process is time-consuming and expensive and the circumferential joints are likely to be highly visible; also, the temporary support structure is expensive and disruptive to the construction process for the remainder of the building.

In accordance with the present invention, there is provided a method of forming a domed construction, comprising the steps of positioning and temporarily supporting a series of elongate structural elements in radially-extending positions, and forming structural joints between the adjoining radial edges of said elements, such that the series of elements form a generally dome-shaped, self-supporting shell.

This method enables long span concrete roofs to be constructed at relatively low cost. Large cranes are available at reasonable cost for lifting the structural elements into position, after they have been fabricated at ground level.

Preferably the structural elements are positioned to rest at their outer ends on a peripheral wall, and to rest at their inner ends on a temporary central tower. After the joints are completed between the adjoining edges of the structural elements, the supporting tower is removed.

It will be appreciated that the construction may be built without any support other than the central tower.

Preferably the structural elements comprise panels or slabs which are cast generally flat and then provided with ribs in order to stiffen them: this then allows the structural elements to be formed to greater lengths and/or width than otherwise possible; the ribs also enable the initial slab to be formed thinner than otherwise possible.

The stiffening ribs may be formed by casting a formation on the top surface of the initially-cast slab. The ribs may be straight or curved and may be of any appropriate shape in cross-section: they may be solid, hollow or with a void filler (e.g. polystyrene).

The initial slab is cast in a horizontal or near-horizontal orientation, obviating the need for a top shutter. The slab may be curved in the longitudinal and/or transverse direction, for forming a continuous curved dome when erected.

Preferably each of the initial slabs has a margin of reduced thickness along its longitudinal edges, with reinforcing bars projecting outwardly over these margins. Preferably, in jointing the adjoining edges of adjacent structural elements, reinforcing bars are lapped over the projecting bars of the two elements, to make the reinforcement structurally continuous. Other means may be used instead to structurally interconnect the reinforcement of the two structural elements, or to mechanically couple the adjoining edges of the two elements.

The joints between the adjacent structural elements are then filled with concrete or other compound (cementitious or otherwise). The jointing compound may be applied by spraying, pouring, grouting or packing, or by a plastering technique.

The formation of insitu concrete joints by pouring requires a top shutter, the reduced-thickness edge margins of the adjacent structural elements forming the bottom shutter. Also, vibration is required and may be provided by a vibrator mounted to the outside of the top shutter. Preferably the top shutter is formed of steel or other metal, which transmits the vibrations with minimal damping: the top shutter is arranged to be moved and repositioned and is preferably mechanically secured, either directly or indirectly, to the structural elements being joined, in order to resist uplift pressure generated by the poured concrete. Preferably the top shutter is formed with holes for venting entrapped air.

The top shutter may be secured temporarily in position by coupling to fittings previously cast into the structural elements: alternatively, anchoring points may be drilled into the structural elements through fixing holes in the shutter, once the latter has been placed in position.

Owing to the length of the structural elements (which may be 50 meters long, for example), there may be vertical misalignment of the adjoining edges of adjacent elements. Preferably steps are then taken to bring the adjoining edges into vertical alignment, to ensure the integrity of the joints formed between them. For this purpose, preferably each structural element is formed with a ballast chamber intermediate its ends, preferably mid-way along its length. Material is introduced into the ballast chambers of selected elements, causing these to deflect by appropriate amounts to bring their longitudinal edges into alignment with their neighbours. The ballast material may comprise concrete or a loose material (e.g. gravel), the latter enabling partial removal to achieve optimum deflection.

In the domed construction which is built, the only joints run radially and, because they run in the same direction as the stiffening ribs, are not visually obtrusive.

An embodiment of the present invention will now be described by way of example only and with reference to the accompanying drawings, in which.

Figure 1:
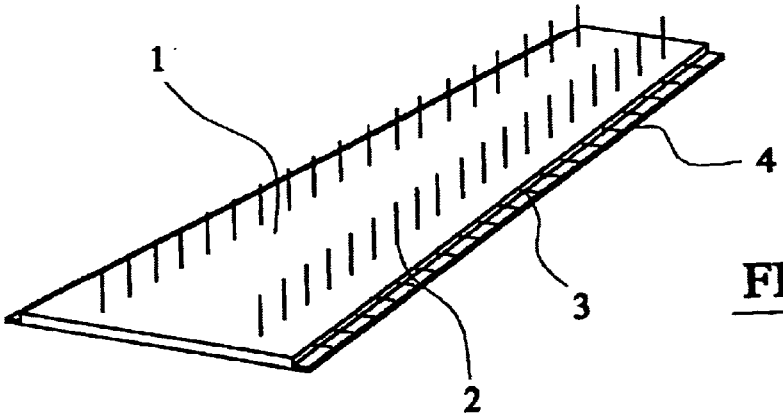
FIG. 1 is a view of an initially-cast slab for forming a structural element for a construction in accordance with the present invention.

Referring to FIG. 1 of the drawings, a set of elongate, flat, tapering slabs are formed of reinforced concrete: one such slab is shown at 1 and is cast horizontally. The slab 1 is formed to a reduced thickness along its longitudinal margins 4. Two lines of starter bars 2 project from the reinforcing mesh and vertically from the upper surface of the slab. Starter bars 3 also project from the reinforcing mesh and horizontally from the horizontal edges of the main body of the slab, over the reduced-thickness margins 4.

Figure 2:
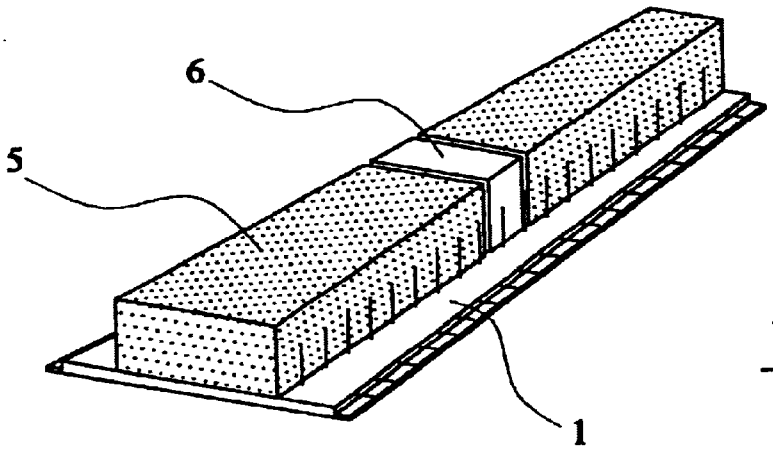
FIG. 2 is a similar view of the slab of FIG. 1, with polystyrene blocks applied to it.
Figure 3:
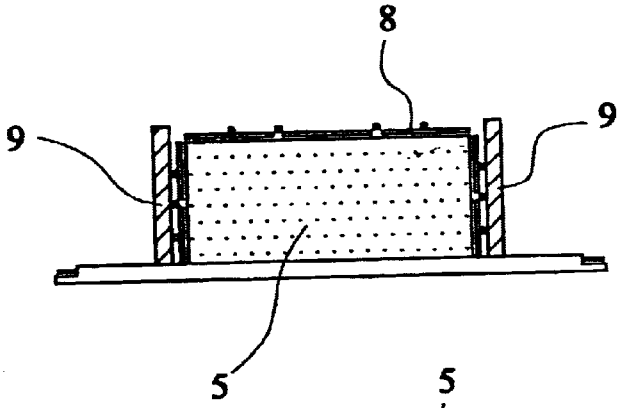
FIG. 3 is a cross-section through the slab, showing reinforcing mesh applied to it and shutters placed along the opposite sides of the polystyrene blocks.
Figure 4:
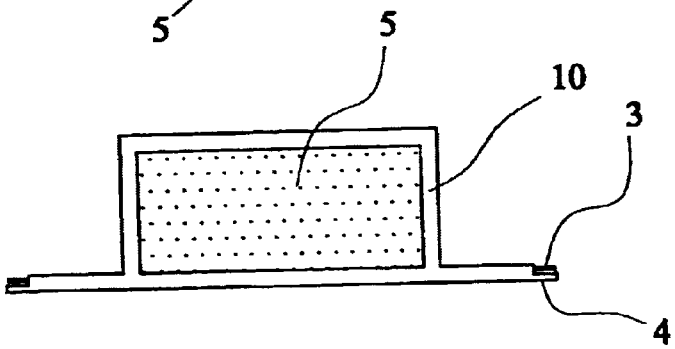
FIG. 4 is a similar cross-sectional view, after a stiffening box has been cast on the initial slab.
Figure 5:
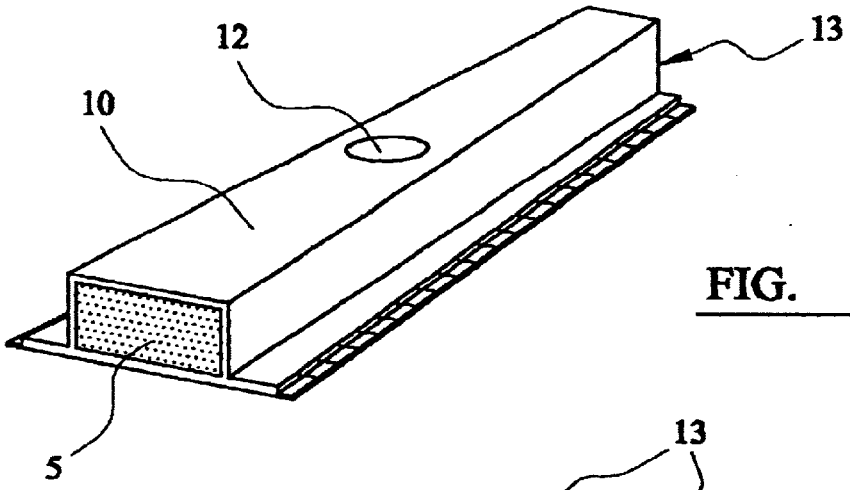
FIG. 5 is a view of the completed structural element.
Figure 7:
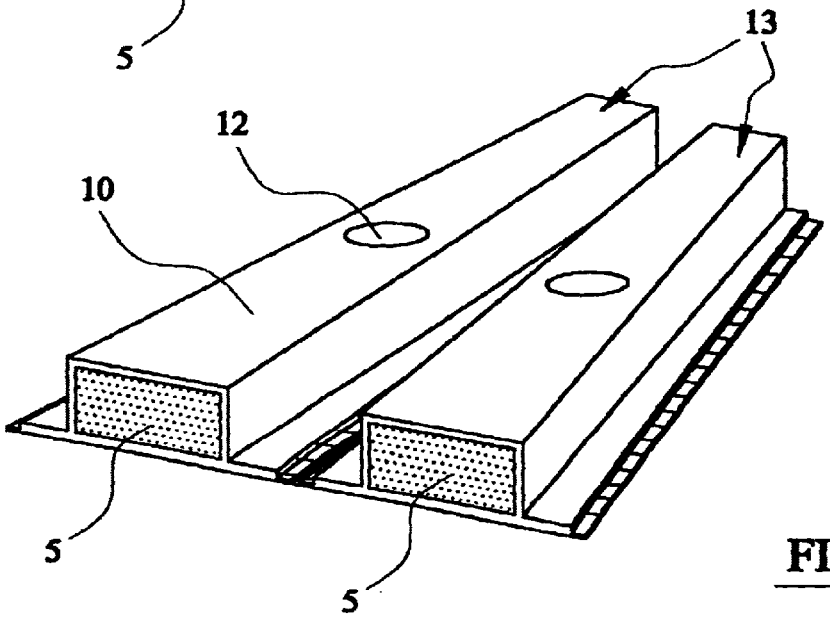
FIG. 7, is a view of two adjoining structural elements in the construction of FIG. 6.
Figure 8:
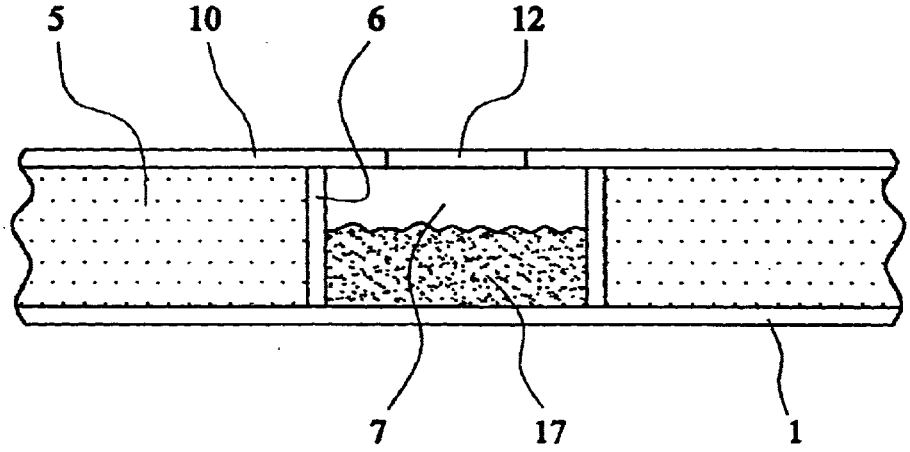
FIG. 8 is a longitudinal section through the ballast compartment of one of the structural elements.

As shown in FIG. 2, elongate filler blocks 5 of polystyrene are placed on the upper surface of the cast slab 1, the blocks 5 being arranged along the length of the slab between the two lines of vertically-projecting starter bars 2. A spacer 6 is positioned between the blocks 5, to act as a former for a ballast chamber. As shown in FIG. 3, reinforcing mesh 8 is positioned over the top and down the opposite sides of the blocks 5 and vertical shutters 9 are positioned along the opposite sides of the blocks 5, outside the starter bars 2 and reinforcement 8. The spaces along the sides of the blocks 5 are then filled with concrete and the space over the top of the blocks is also filled with concrete, the concrete then being allowed to set: as shown in FIGS. 4 and 5, there is thus produced a tapered, stiffened element 13, comprising the initially-cast slab 1 stiffened by a box-shaped rib 10. An aperture 12 is formed in the top wall of the box 10, into the ballast chamber: the spacer 6 may comprise a wooden box which is then broken up and removed through the aperture 12, or simply left in place.

Figure 6:
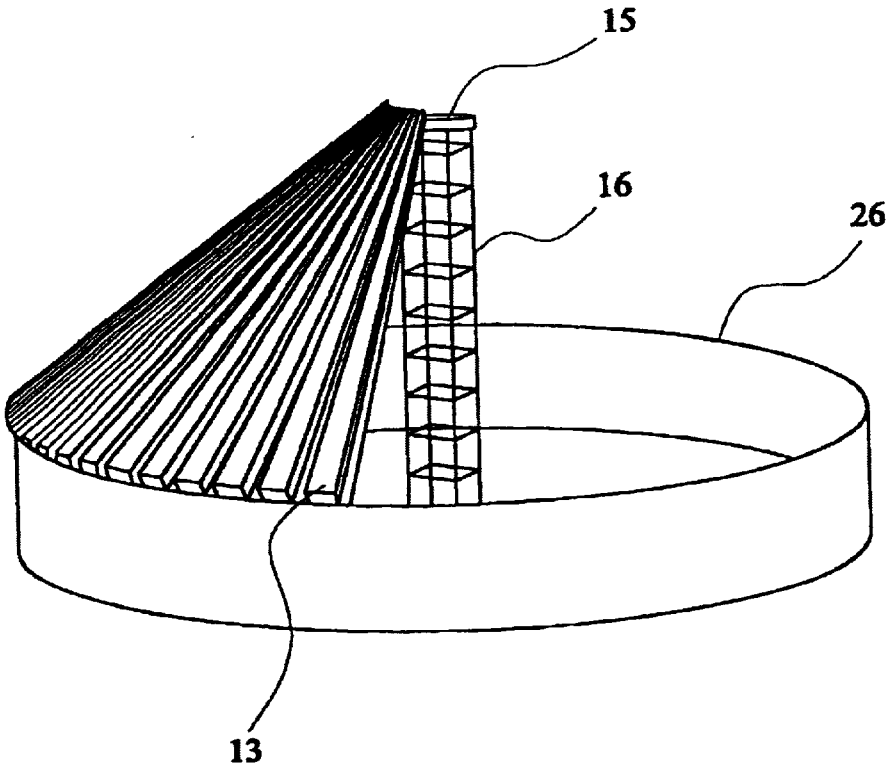
FIG. 6 is a view showing a domed construction being formed in accordance with the present invention.
Figure 12:
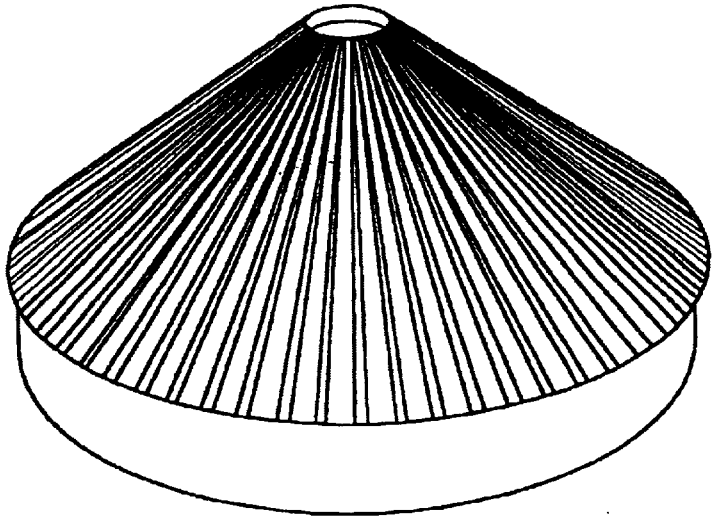
FIG. 12 is a view of the completed construction.

Referring to FIG. 6, a dome-shaped construction is built from a series of the tapered, stiffened elements 13. Thus, a circular wall 26 is built and a tower 16 is temporarily erected at the centre of the circular space within the wall 26: a connecting ring 15 is supported at the top of the tower 16. The structural elements 13 are then placed into position, edge-to-edge, with their wider ends resting on the top of the wall 26 and their narrower ends resting on the connecting ring 15.

Thereafter, the adjoining longitudinal edges 4 of the elements 13 are surveyed for vertical alignment. Calculated amounts of gravel 17 are then added to the ballast chambers 7 of appropriate elements, via the respective apertures 12, to bring the adjoining longitudinal edges into sufficient alignment, ready for joints to be formed between the elements radially of the construction.

Figure 11:
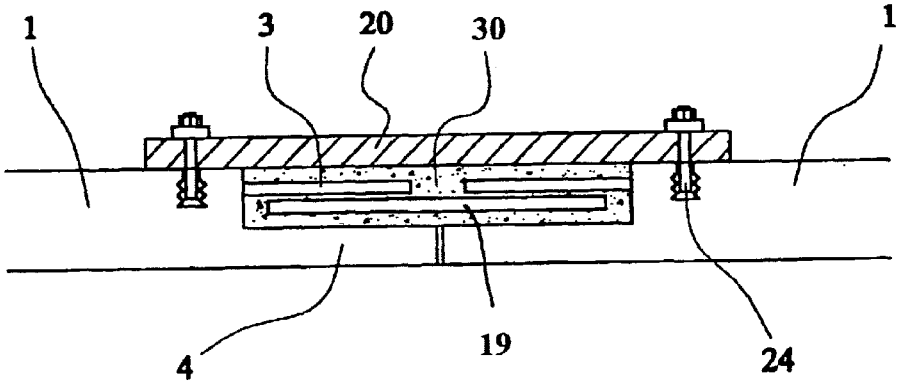
FIG. 11 is an enlarged cross-sectional view of the joint.

For forming each such radial joint, a series of link bars 19 are laid across the abutting edges of the two structural elements, in the space over the reduced-thickness margins 4, as shown in FIG. 11, to link the projecting starter bars 3. Then a steel shutter 20 is positioned to extend along the joint and rest on the top surface of the two elements: the shutter 20 is fixed in position by means of bolts 24 inserted through holes in the shutter and into bores drilled in the elements; these bores are pre-drilled using the shutter 20 as a template.

Concrete 30 is introduced into the joint space under the shutter via the open top end of the shutter, as indicated by the arrow 25: the concrete thus introduced is compacted using a vibrator 27 fixed to the exterior surface of the shutter 20, air escaping through venting holes 28 in the shutter. The shutter 20 is removed after the jointing concrete has set and the apertures 12 in the tops of the stiffening ribs are sealed. Finally, the temporary tower 16 is removed, the structure now forming a self-supporting concrete shell.

Figure 9:
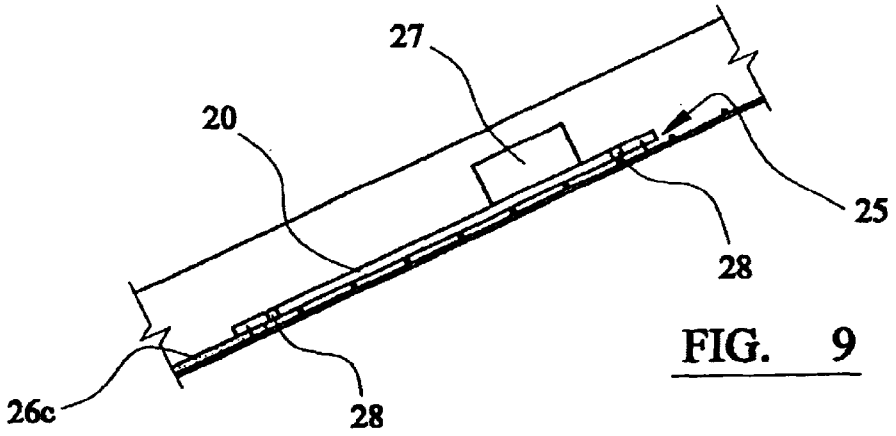
FIG. 9 is a longitudinal section through a joint being formed between two adjoining structural elements.
Figure 10:
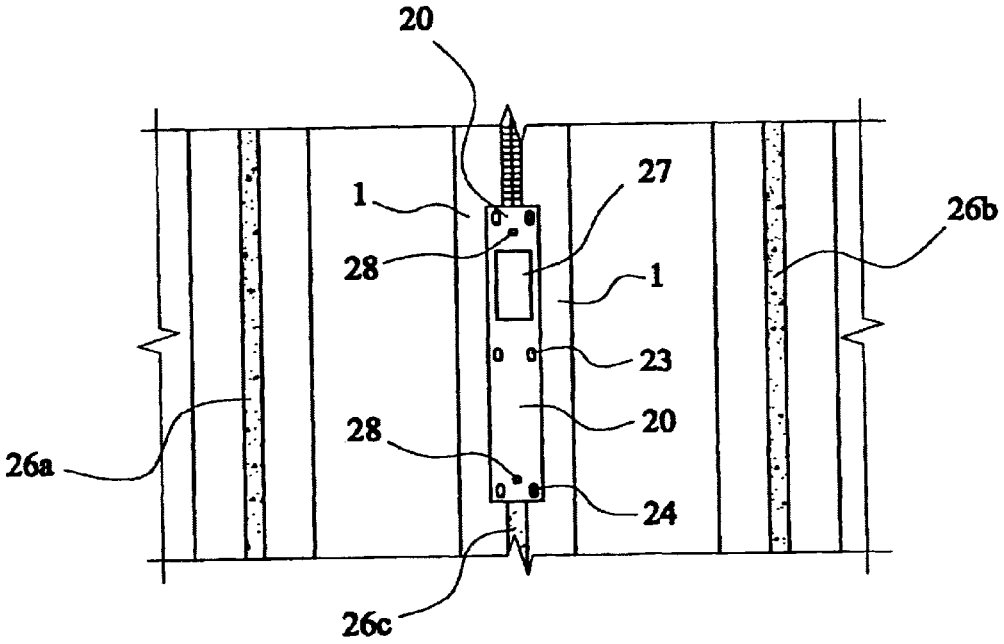
FIG. 10 is a plan view of the joint being formed.

In FIG. 10, two completed joints are shown at 26*a*, 26*b*. The shutter 20 is shown in use, in FIGS. 9 and 10, to extend a partially-completed joint 26*c* and the lower edge of the shutter is positioned to overlap the upper end of the partially completed joint 26*c*.

What is claimed is:

1. A method for forming a generally dome-shaped construction, comprising the steps of:

providing elongate structural elements formed of concrete and having longitudinal margins formed to a reduced thickness with said elongate structural elements further comprising an embedded reinforcement projecting from longitudinal edges of said elongate structural elements in a space above said longitudinal margins;

positioning and temporarily supporting said elongate structural elements in radially-extending positions wherein said elongate structural elements each extend from a periphery to an apex of a construction of said generally dome-shaped construction; and, forming structural joints between adjoining radial edges of said elongate structural elements, so that said elongate structural elements form a self-supporting shell of a generally dome shape, said structural joints between said radial edges of said elongate structural elements being formed in a space over said longitudinal margins and further comprising an application of an additional reinforcement for structurally interconnecting said embedded reinforcement of adjacent elongate structural elements.

2. A method for forming a generally dome-shaped construction, comprising the steps of:

providing elongate structural elements formed of concrete and having longitudinal margins formed to a reduced thickness;

positioning and temporarily supporting said elongate structural elements in radially-extending positions wherein said elongate structural elements extend from a periphery to an apex of a construction of said generally dome-shaped construction; and, forming structural joints between adjoining radial edges of said elongate structural elements for forming a self-supporting shell of a generally dome shape, said structural joints between said radial edges of said elongate structural elements being formed by introducing concrete into a space over said longitudinal margins after securing a top shutter in position over said space.

3. The method for forming a generally dome-shaped construction according to claim 2, further comprising a vibrator mounted to an outer side of said top shutter.

4. A method for forming a generally dome-shaped construction, comprising the steps of:

providing elongate structural elements formed of concrete;

positioning and temporarily supporting said elongate structural elements in radially-extending positions wherein said elongate structural elements each extend from a periphery to an apex of a construction of said generally dome-shaped construction;

adding ballast to selected said elongate structural elements for bringing adjoining radial edges of said elongate structural elements into alignment in a vertical direction; and, forming structural joints between said adjoining radial edges of said elongate structural elements, so that said elongate structural elements form a self-supporting shell of a generally dome shape.

5. The method for forming a generally dome-shaped construction according to claim 4, wherein each of said elongate structural elements is formed with a chamber for receiving said ballast.

6. A method for forming a generally dome-shaped construction, comprising the steps of:

providing elongate structural elements formed of concrete and having longitudinal margins formed to a reduced thickness;

positioning and temporarily supporting said elongate structural elements in radially-extending positions wherein said elongate structural elements extend from a periphery to an apex of a construction of said generally dome-shaped construction; and, forming structural joints between adjoining radial edges of said elongate structural elements, so that said elongate structural elements form a self-supporting shell of a generally dome shape, said structural joints between said radial edges of said elongate structural elements being formed by introducing a jointing compound into a space over said longitudinal margins after securing a top shutter in position over said space.

7. A method for forming a generally dome-shaped construction, comprising the steps of:

providing a series of elongate structural elements formed of concrete and comprised of substantially flat slabs provided with stiffening ribs extending longitudinally thereof;

providing a first supporting structure at a periphery of a construction of said generally dome-shaped construction;

providing a second supporting structure at a center area of said construction;

lifting said elongate structural elements into positions wherein said elongate structural elements extend radially-inwardly and upwardly from the periphery of said construction to an apex of said construction, with radially-outer ends of said elongate structural elements resting on said first supporting structure and radially-inner ends of said elongate structural elements resting on said second supporting structure;

forming structural joints between adjoining radial edges of said elongate structural elements, so that said elongate structural elements form a self-supporting shell having a generally dome shape; and, subsequently removing said second supporting structure.

8. The method for forming a generally dome-shaped construction according to claim 7, wherein said elongate structural elements are positioned to rest at their outer ends on a peripheral wall and at their inner ends on a temporary support tower.

9. The method for forming a generally dome-shaped construction according to claim 7, wherein said stiffening ribs are formed via casting on one side of said substantially flat slabs.

10. The method for forming a generally dome-shaped construction according to claim 7, wherein said stiffening ribs are solid.

11. The method for forming a generally dome-shaped construction according to claim 7, wherein said stiffening ribs are hollow with a void filler therein.

12. The method for forming a generally dome-shaped construction according to claim 7, wherein said elongate structural elements include embedded reinforcement projecting from longitudinal edges of said elongate structural elements.

13. A method for forming a generally dome-shaped construction, comprising the steps of:

providing a series of elongate structural elements formed of concrete and having longitudinal margins formed for reducing thickness;

providing a first supporting structure at a periphery of a construction of said generally dome-shaped construction;

providing a second supporting structure at a center area of said construction;

lifting said elongate structural elements into positions wherein said elongate structural elements extend radially-inwardly and upwardly from the periphery of said construction to an apex of said construction, with radially-outer ends of said elongate structural elements resting on said first supporting structure and radially-inner ends of said elongate structural elements resting on said second supporting structure;

forming structural joints between adjoining radial edges of said elongate structural elements, so that said elongate structural elements form a self-supporting shell having a generally dome shape, said structural joints being formed in a space over said longitudinal margins of said elongate structural elements; and, subsequently removing said second supporting structure.

14. The method for forming a generally dome-shaped construction according to claim 13, wherein said elongate structural elements are positioned to rest at their outer ends on a peripheral wall and at their inner ends on a temporary support tower.

15. The method for forming a generally dome-shaped construction according to claim 13, wherein said elongate structural elements include embedded reinforcement projecting from longitudinal edges of said elongate structural elements.

* * * * *